US008231297B2

(12) United States Patent
Legassie et al.

(10) Patent No.: US 8,231,297 B2
(45) Date of Patent: Jul. 31, 2012

(54) RETRACTABLE COSMETIC DISPENSER WITH DISTAL AND LATERAL WIPING

(76) Inventors: Raymond P. Legassie, Laconia, NH (US); Thomas F. Holloway, Southbury, CT (US); Frederick J. Dobbins, Prospect, CT (US); Stephen G. Dudienski, Ansonia, CT (US)

( * ) Notice: Subject to any disclaimer, the term of this patent is extended or adjusted under 35 U.S.C. 154(b) by 451 days.

(21) Appl. No.: 12/482,382

(22) Filed: Jun. 10, 2009

(65) Prior Publication Data

US 2010/0139686 A1 Jun. 10, 2010

Related U.S. Application Data

(60) Provisional application No. 61/060,423, filed on Jun. 10, 2008.

(51) Int. Cl.
*A46B 11/00* (2006.01)

(52) U.S. Cl. ..... 401/122; 401/121; 401/117

(58) Field of Classification Search ..... 401/99, 401/116, 117, 121, 122
See application file for complete search history.

(56) References Cited

U.S. PATENT DOCUMENTS

| | | | | |
|---|---|---|---|---|
| 1,244,798 | A * | 10/1917 | Tharp et al. | 401/19 |
| 4,029,422 | A | 6/1977 | Pillsbury | |
| 4,428,388 | A | 1/1984 | Cassai et al. | |
| 4,671,689 | A | 6/1987 | Gueret | |
| 4,687,364 | A | 8/1987 | Kingsford | |
| 4,778,300 | A | 10/1988 | French et al. | |
| 4,838,722 | A | 6/1989 | Katz | |
| 5,332,325 | A | 7/1994 | Crosnier et al. | |
| 5,349,972 | A | 9/1994 | Dirksing et al. | |
| 5,597,254 | A | 1/1997 | Vasas | |
| 5,791,800 | A | 8/1998 | Katz | |
| 5,951,186 | A | 9/1999 | Lhuisset | |
| 6,010,265 | A | 1/2000 | Bouix | |
| 6,231,256 | B1 | 5/2001 | Kingsford et al. | |
| 6,371,129 | B1 | 4/2002 | Le Bras-Brown et al. | |
| 6,375,374 | B2 | 4/2002 | Gueret | |
| 6,718,990 | B1 | 4/2004 | Chastain et al. | |
| 7,237,973 | B1 | 7/2007 | Lou | |
| 2004/0184865 | A1 | 9/2004 | Carroll | |

FOREIGN PATENT DOCUMENTS

| | | |
|---|---|---|
| FR | 979157 | 12/1950 |
| FR | 1271920 | 10/1960 |
| WO | WO03015567 | 2/2003 |
| WO | WO2005032301 | 4/2005 |

* cited by examiner

*Primary Examiner* — David Walczak
(74) *Attorney, Agent, or Firm* — O'Connell Law Firm

(57) ABSTRACT

A cosmetic dispenser with a bottle and an applicator wand retained for slidable extension and retraction relative to the bottle. The applicator wand can be slid from a retracted position wherein a cosmetic applicator is retained within the bottle and an extended position wherein the cosmetic applicator projects through an aperture at a distal end of the bottle. A lateral dividing structure, which can be formed by an adapter insert and a rear seal, slidably receives the applicator wand and divides the inner volume of the bottle into a distal inner volume and a proximal inner volume. A laterally disposed distal wiping wiper with a plurality of radial slits can wipe a distal end of the cosmetic applicator, and a side wiping wiper with an inner throat can wipe a peripheral portion of the cosmetic applicator. A cap with a plug can matingly engage the side wiping wiper.

19 Claims, 7 Drawing Sheets

RETRACTABLE COSMETIC DISPENSER WITH DISTAL AND LATERAL WIPING

FIELD OF THE INVENTION

The present invention relates generally to dispensers for fluid materials, such as cosmetics. More particularly, disclosed and protected hereby is an extendable and retractable dispenser with distal and lateral wiping for facilitating proper applicator loading and improved applicator performance.

BACKGROUND OF THE INVENTION

Cosmetic dispensers for mascara and other liquid or pasty cosmetics commonly comprise two-piece assemblies, namely a container and a cap. The container has an open inner volume for retaining a volume of the cosmetic, and the cap has a wand projecting therefrom with a brush or other structure for being dipped in the cosmetic. When dipped in the cosmetic, the brush becomes loaded with the liquid or pasty cosmetic material for application. By a threaded engagement between the cap and a neck of the container, the cosmetic dispenser can be sealed during periods of nonuse.

During cosmetic application, therefore, a user will normally retain the cap in one hand and the applicator in the other to enable repeated dipping and, consequently, the successful application of the cosmetic. However, occupying both hands with the application of the cosmetic is awkward and leaves the user substantially unable to carry out other functions, such as holding a mirror or another cosmetic article. Mascara is commonly applied in such a manner as are other liquid, semi-liquid, pasty or related cosmetics, including lip gloss, concealer, eye shadow, and further cosmetics.

It has thus been a longfelt need in the cosmetics industry to provide a cosmetic dispenser that can be reliably operated with a single hand. Advantageously, a number of skilled inventors have attempted to devise cosmetic operators capable of one-handed operation. However, as the dearth of such devices on the commercial market demonstrates, the creation of a commercially viable structure has thus far not been achieved.

For example, in U.S. Patent Application Publication No. 2004/018865, Carroll discloses a retractable cosmetic applicator that is designed to be capless. The applicator passes from a refracted position to an extended position through an aperture with a front cowling and a valve. The valve is said to substantially seal the aperture when the applicator is in a retracted position thereby eliminating a need for a cap. With that, one handed operation of the device is said to be possible. However, it does not appear that any accommodation is made to address the buildup of backwiped product on and around the aperture as the applicator is extended and retracted. Furthermore, the spring-loaded structure appears to be relatively complex in structure and operation thereby increasing the likely overall cost of manufacture and resultantly increasing the ultimate price that must be paid by the end consumer.

A further longstanding difficulty that many prior art inventors have sought to confront is the proper loading of cosmetic onto the applicator since that proper loading is critical to the efficient application of cosmetics. A related problem known to the art is the undesired buildup of cosmetic material on the tip and body of the dispenser, the rim of the container, and elsewhere, particularly after repeated applications. There has, therefore, been a longfelt need for a cosmetic dispenser that ensures proper loading of the applicator while avoiding unwanted buildup, preferably with excess cosmetic material being returned to the open inner volume of the container.

Notwithstanding the appreciation of such difficulties and needs, inventors of the prior art have been unable to provide an effective and elegant solution to the same. For example, U.S. Pat. No. 4,671,689 to Gueret is directed to a makeup unit wherein a cosmetic applicator is retained relative to a cap. A laterally communicating wiper has a plurality of slits communicating radially from an open center portion. With this, the wiper provides a wiping of the side of the cosmetic applicator as it is pulled from within the bottle. However, it would appear that the distal end of the cosmetic applicator would not be automatically wiped whereby the problems of tailing and mascara buildup at the distal end of the cosmetic applicator are not remedied.

For these and further reasons, cosmetic dispensers of the prior art are often messy and inefficient in use. For example, a common problem experienced by users of current mascara dispensers is known as "tailing" where a tail of mascara is left on the distal end of the applicator, such as at the tip of the applicator brush in a mascara applicator. Since the dispensers typically employ a wiper that is generally sized to the diameter of the plastic portion of the applicator wand, the wiper does not engage the "tail" of mascara even as the brush passes through the wiper. As a result, a small blob of mascara is left at the end of the brush. This small blob of mascara can fall from the brush or be undesirably applied to the skin or hair of the user. While experienced mascara users often wipe the end of the brush on the inner portion of the lip of the mascara container, the wiped blob can contribute to increased buildup on and around the rim of the dispenser, on the mascara wand, and elsewhere thereby increasing messiness and waste.

In light of the foregoing, it will be appreciated that there is a need in the art for a cosmetic dispenser that overcomes the disadvantages common to prior art dispensers while permitting efficient one-handed operation in the application of cosmetics.

SUMMARY OF THE INVENTION

Advantageously, the present invention is founded on the basic object of providing a cosmetic dispenser that can be operated effectively with a single hand.

Another object of embodiments of the invention is to provide a cosmetic dispenser that can be extended and retracted between storage and use positions.

A further object of embodiments of the invention is to provide a cosmetic dispenser that ensures a proper loading of liquid or pasty cosmetics.

An even further object of embodiments of the invention is to reduce or eliminate tailing from the tip of the dispenser.

Embodiments of the invention have the still further objects of minimizing mess and preventing waste.

These and further objects and advantages of embodiments of the invention will become obvious not only to one who reviews the present specification and drawings but also to one who has an opportunity to make use of an embodiment of the instant invention for a cosmetic dispenser disclosed herein. The accomplishment of each of the foregoing and possibly further objects in a single embodiment of the invention may be possible and indeed preferred. However, it will be appreciated that not all embodiments will seek or need to accomplish each and every potential object and advantage. Nonetheless, all such embodiments should be considered within the scope of the present invention.

In carrying forth the aforementioned and further objects, a basic embodiment of the cosmetic dispenser disclosed herein is founded on a bottle with an open inner volume, a closed proximal end, and a distal end with an aperture. An applicator wand is retained for slidable extension and retraction relative to the bottle. A base member, which can comprise a base cup, is fixed to a proximal end of the applicator wand, and a cosmetic applicator, such as a brush or other means, is retained by the distal end of the applicator wand. A longitudinal slide channel in combination with a slide member, such as a slide button, operate as a means for enabling a selective sliding of the applicator wand from a refracted position wherein the cosmetic applicator is retained within the open inner volume of the bottle and an extended position wherein the cosmetic applicator projects through the aperture at the distal end of the bottle. The open inner volume of the bottle is divided into a distal open inner volume to a distal side of a lateral dividing structure and a proximal open inner volume to a proximal side of the lateral dividing structure. The distal open inner volume is in fluidic communication with the aperture in the distal end of the bottle but is fluidically sealed in relation to the proximal open inner volume. An aperture in the dividing structured slidably receives the applicator wand to permit the cosmetic applicator to be extended and retracted.

In certain embodiments, the slide member can be engaged with the applicator wand by at least one leg with a first end fixed to the slide member and a second end engaged with the base member that is fixed to the proximal end of the applicator wand. Further, the lateral dividing structure can be formed by an adapter insert with a base and a peripheral wall. The aperture in the lateral dividing structure can then be in the base concentric with the bottle, and the peripheral wall can have a size and shape corresponding to a size and shape of an inner wall surface of the bottle.

Embodiments of the cosmetic dispenser can have a body portion that is formed by a base shell with a closed proximal end and an open distal end and a bottle sleeve with an open proximal end for engaging the open distal end of the base shell. Under such constructions, the adapter insert can have a peripheral rim that overlies the distal end of the base shell. Furthermore, the lateral dividing structure can additionally include a rear seal with a peripheral wall and a base with a through-hole that slidably receives the applicator wand. Where the adapter insert and the rear seal can be matingly engaged, and the bases of the rear seal and the adapter insert are disposed proximal to the peripheral walls of the rear seal and the adapter insert. So disposed, the peripheral walls and the base portions cooperate to define a reception well into which the cosmetic applicator can be dipped.

In particular manifestations of the cosmetic dispenser, a laterally disposed distal wiping wiper can be included. The distal wiping wiper can have a bottom wall that communicates laterally across the open inner volume of the bottle distal to the cosmetic applicator and the applicator wand when the applicator wand is in a retracted position. A plurality of radial slits can be disposed in the bottom wall for permitting a passage of the cosmetic applicator through the distal wiping wiper and for enabling a wiping of a distal end of the cosmetic applicator.

Still further, a side wiping wiper can be disposed within the bottle for wiping cosmetic material from peripheral portions of the cosmetic applicator. The side wiping wiper can have a longitudinal annular inner wall portion adjacent to a distal end thereof and a frusto-conical inner portion that narrows to an annular inner throat, and the side wiping wiper can be disposed distal to the distal wiping wiper within the bottle. With such a side wiping wiper, a cap can be employed for sealing the distal open inner volume of the bottle, and the cap can have a concentric plug that projects proximally to mate with the side wiping wiper. More particularly, the plug of the cap can have a tip for being received within the throat of the side wiping wiper and a frusto-conical portion corresponding to the frusto-conical inner portion of the side wiping wiper to ensure that residual cosmetic material is returned to the open inner volume of the bottle.

One will appreciate that the foregoing discussion broadly outlines the more important features of the invention to enable a better understanding of the detailed description that follows and to instill a better appreciation of the inventors' contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

It will be appreciated that the cosmetic dispenser disclosed herein is subject to widely varied embodiments. However, to ensure that one skilled in the art will be able to understand and, in appropriate cases, practice the present invention, certain preferred embodiments of the broader invention revealed herein are described below and shown in the accompanying drawing figures.

Figure 1A:
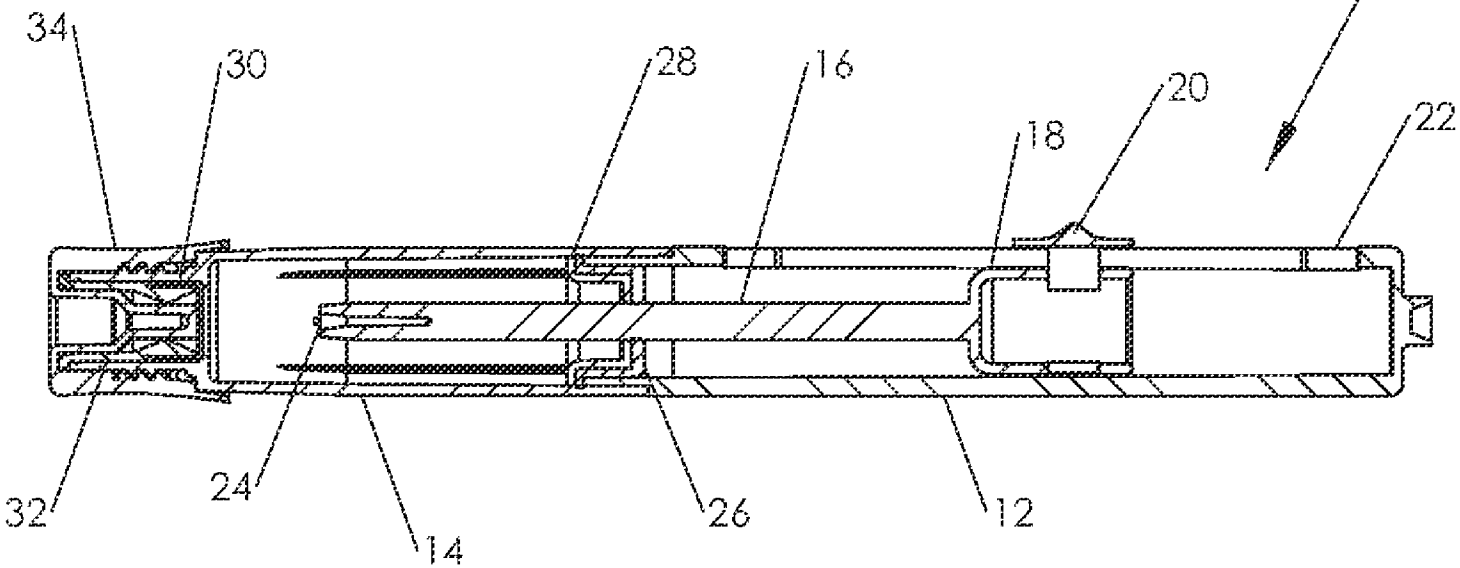
FIG. 1A is a sectioned view in side elevation of a retractable cosmetic applicator with distal and lateral wiping according to the invention disclosed herein.
Figure 1B:
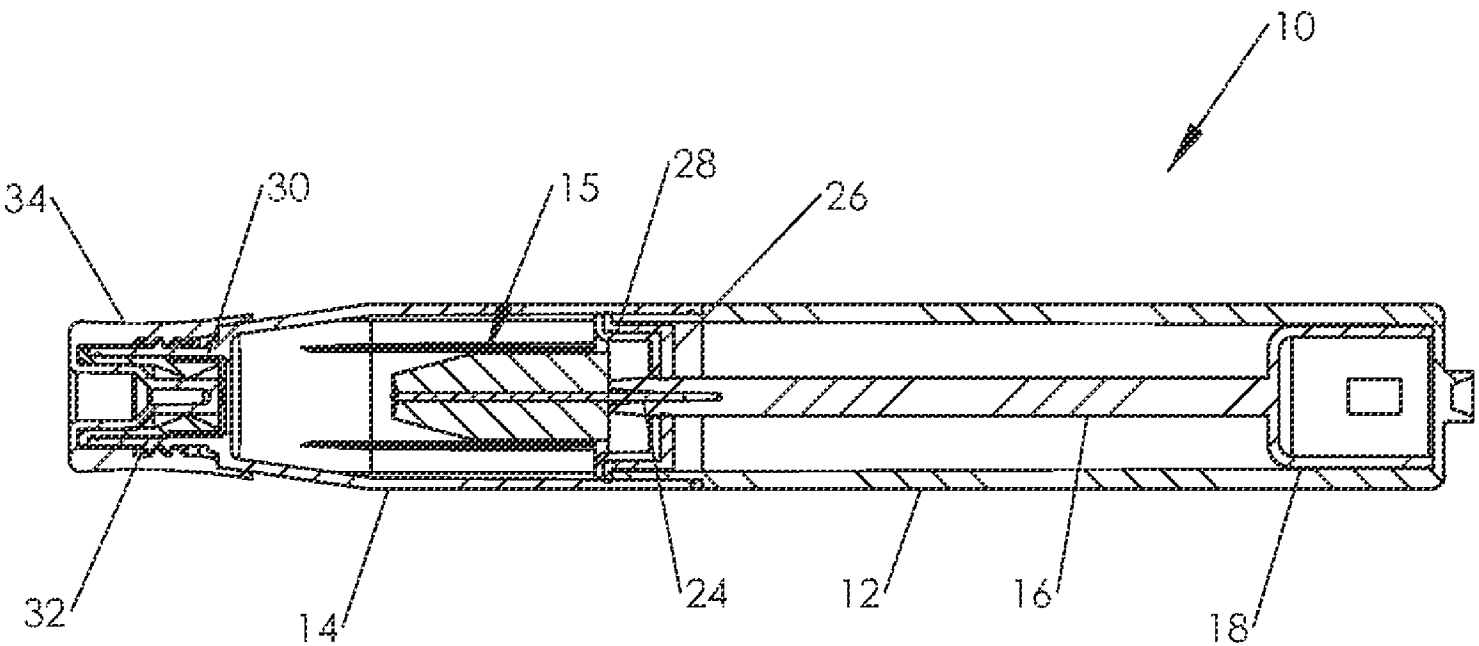
FIG. 1B is a sectioned view in side elevation of an alternative retractable cosmetic applicator with distal and lateral wiping under the invention.

Looking first to the cross-sectional views of FIGS. 1A and 1B, first and second embodiments of a cosmetic dispenser pursuant to the present invention are indicated generally at 10. In each embodiment, a body portion of the cosmetic dispenser 10 is formed by the joining of a base shell 12 and a bottle sleeve 14 that together form a bottle. The base shell 12 is shown in perspective and cross-sectional views in FIGS. 2 and 3, and the bottle sleeve 14 is shown in perspective and cross-sectional views in FIGS. 4 and 5. With combined reference to FIGS. 1A through 5, one can perceive that the base shell 12 and the bottle sleeve 14 can have body portions 35 and 42 that are generally oval in cross section.

Figure 2:
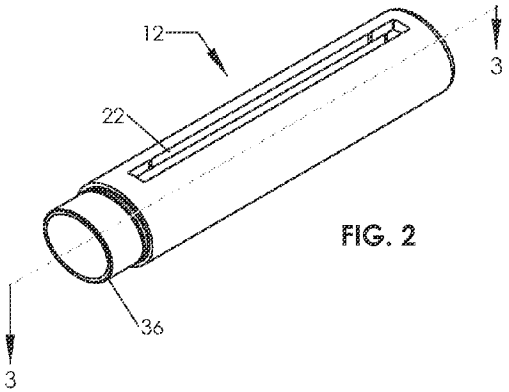
FIG. 2 is a perspective view of a shell of a cosmetic applicator as taught herein.
Figure 3:
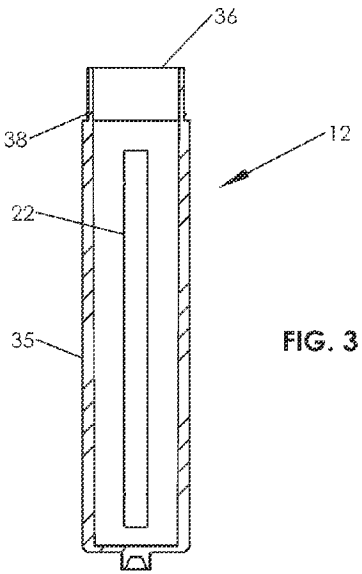
FIG. 3 is a cross-sectioned view in side elevation of the shell taken along the line 3-3 in FIG. 2.
Figure 4:
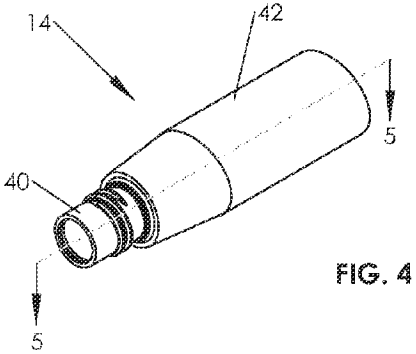
FIG. 4 is a perspective view of a bottle sleeve under the current invention.
Figure 5:
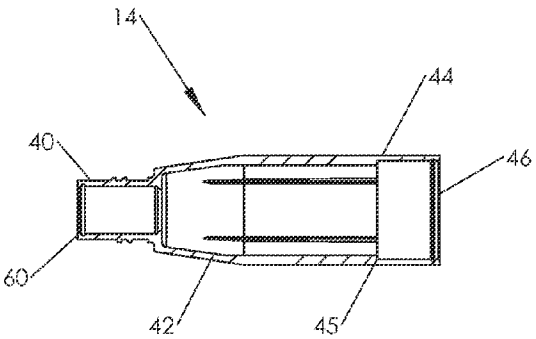
FIG. 5 is a cross-sectioned view in side elevation of the bottle sleeve taken along the line 5-5 in FIG. 4.

As shown in FIGS. 2 and 3, the base shell 12 can have a closed first end and an open second end. The second end of the base shell 12 terminates in a neck 36 that is proportionally smaller than the remainder of the body portion 35. A peripheral ridge 38 encircles the neck 36, such as adjacent to the proximal portion thereof. As depicted in FIGS. 4 and 5, the body portion 42 of the bottle sleeve 14 has an open receiving portion 44 at the first end thereof and a threaded neck 40 at the second end thereof. A peripheral channel 46 is disposed adjacent to the first end of the bottle sleeve 14 to align longitudinally with the peripheral ridge 38 of the base shell 12.

The receiving portion 44 of the bottle sleeve 14 can be dimensioned to receive the neck 36 of the base shell 12, and the peripheral ridge 38 can be dimensioned to engage the peripheral channel 46. Under this arrangement, the base shell 12 can be engaged with the bottle sleeve 14 by an insertion of the neck 36 of the base shell 12 into the receiving portion 44 until the peripheral ridge 38 engages the peripheral channel 46. With that, the base shell 12 and the bottle sleeve 14 are secured together.

Figure 6:
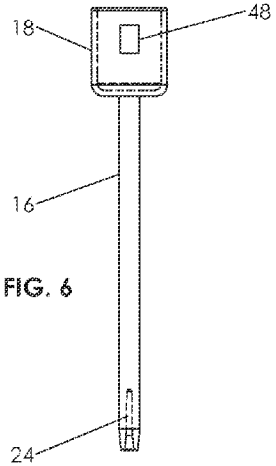
FIG. 6 is a cross-sectional view of a mascara rod and base assembly.

An applicator wand 16 with a proximal end fixed to a base cup 18 that acts as a base member and a distal end for retaining a cosmetic applicator, such as a mascara brush or other means, is retained for slidable extension and refraction relative to the base shell 12 and the bottle sleeve 14. The applicator wand 16 and the base cup 18 are shown alone in FIG. 6. The base cup 18 has an oval outer wall dimensioned marginally smaller than the inner diameter of the base shell 12 thereby to assist in maintaining the applicator wand 16 and the base cup 18 in axial alignment relative to the base shell 12, the bottle sleeve 14, and the cosmetic dispenser 10 in general.

Figure 7:
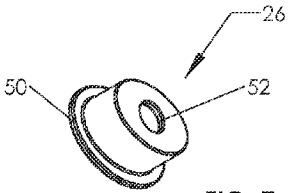
FIG. 7 is a perspective view of an adaptor insert employed under the instant invention.
Figure 8:
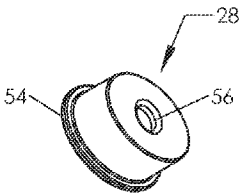
FIG. 8 is a perspective view of a rear seal pursuant to the invention.

The base shell 12 has a slide channel 22 that communicates longitudinally therealong, and the base cup 18 has a rectangular fastening aperture 48 in the outer wall thereof disposed to align with the slide channel 22. With this, a slide button 20 that acts as a slide member can engage the base cup 18 through the slide channel 22 to enable a user to extend and retract the base cup 18, the applicator wand 16, and any cosmetic applicator retained relative thereto by a selective sliding of the slide button 20. The slide button 20 can have an engaging portion for engaging a user's finger and first and second opposed, resiliently deflectable legs with outwardly disposed, distal protuberances whereby the legs can pass through the slide channel 22 and snap engage the wall of the base cup 18 through the fastening aperture 48, The alignment of the applicator wand 16 and a retained applicator 15 can be ensured by an adapter insert 26, which is shown apart in FIG. 7, that acts as a lateral dividing structure. The adapter insert 26 has a body portion with a base that has a concentrically disposed aperture 52 therein sized to receive the applicator wand 16 in a slidable relationship. The adapter insert 26 has an outer wall with an oval cross section corresponding to the shape and size of the base shell 12 and a peripheral rim 50 greater in lateral dimensions than the corresponding inner dimensions of the base shell 12.

With this, the base portion and the outer wall of the adapter insert 26 can be received in the second end of the bottle sleeve 14 while the peripheral rim 50 overlies that second end of the base shell 12. The adapter insert 26 can thereby effectively plug the second end of the base shell 12 while being retained securely in place with the peripheral rim 50 sandwiched, together with the peripheral rim 54 of the rear seal 28 described below, between the distal end of the neck 36 of the base shell 12 and the shoulder 45 of the bottle sleeve 14.

The adapter insert 26 can be formed from any suitable material, preferably a material demonstrating sufficient rigidity and durability to provide support to the applicator wand 16. In one presently contemplated embodiment, the adapter insert 26 can be crafted of high-density polyethylene (HDPE). Of course, other means for maintaining the alignment of the applicator wand 16 and the retained applicator 15, whether it be a brush, fingers, or any other type of applicator 15, are possible and within the scope of the invention.

The first end of the bottle sleeve 14 can be effectively sealed in relation to the base shell 12 by a rear seal 28 together with the applicator wand 16 that is slidably received through a concentric through-hole 56 in the base of the rear seal 28. Similar to the adapter insert 26, the rear seal 28 has an outer wall with an oval cross section and a peripheral rim 54 greater in lateral dimensions than the corresponding inner dimensions of the base shell 12. The through-hole 56 can be dimensioned to have a diameter close to the diameter of the applicator wand 16, whether it be slightly less than, slightly greater than, or generally equal to the diameter of the applicator wand 16.

With this, in addition to sealing the first end of the bottle sleeve 14 to define a substantially liquid-tight open inner volume, the rear seal 28 can clean liquid or pasty cosmetic material from the applicator wand 16 as it is retracted into the base shell 12 by operation of the slide button 20. To facilitate the wiping of the pasty cosmetic material and the effective sealing of the open inner volume, the rear seal 28 can be formed from a durable yet pliable material. In one preferred example, the rear seal 28 can be formed from a thermoplastic elastomer (TPE) and can preferably have a hardness in the range of Shore 46 D.

The rear seal 28 can be disposed in opposition to the adapter insert 26 not shown) or seated within the adapter insert 26 as in FIGS. 1A and 1B. Where the rear seal 28 is disposed in opposition to the adapter insert 26, the peripheral wall thereof can have outer dimensions sized to be received closely within the bottle sleeve 14. Where the rear seal 28 is seated within the adapter insert 26, the peripheral wall thereof can have outer dimensions sized to be received closely within the peripheral wall of the adapter insert 26.

In either case, the rear seal 28 can render the first end of the bottle sleeve 14 liquid tight while allowing the applicator wand 16 to slide therethrough. Together with the adapter insert 26, the rear seal 28 can be securely retained in place with its peripheral rim 54 sandwiched between the distal end of the neck 36 of the base shell 12 and the shoulder 45 of the bottle sleeve 14. Where the rear seal 28 is seated within the adapter insert 26 as in FIG. 1A, its peripheral wall and the base portion cooperate to define a reception well in cooperation with and in supplementation of the open inner volume of the bottle sleeve 14. When the applicator wand 16 and the cosmetic applicator 15 are fully retracted as in FIG. 1A, the reception well permits the effective retrieval and application of a greater percentage of retained cosmetic product as the cosmetic applicator 15 is dipped into the reception well and the cosmetic product retained therein. Looking again to FIGS. 4 and 5, the bottle sleeve 14 has a threaded neck 40 for engaging a threaded cap 34 thereby enabling the open inner volume of the bottle sleeve 14 to be fully sealed.

Figure 9:
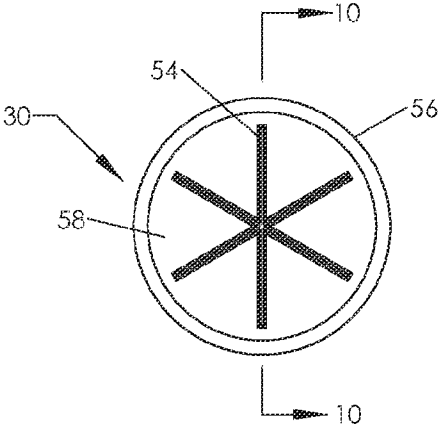
FIG. 9 is a top plan view of a flat wiper as employed herein.
Figure 10:
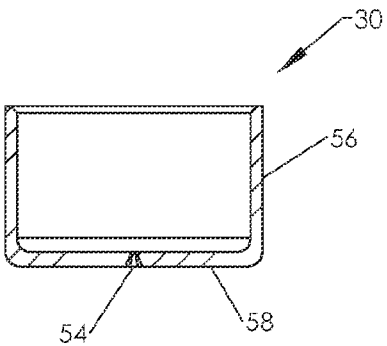
FIG. 10 is a cross-sectional view of the flat wiper taken along the line 10-10 in FIG. 9.

What can be referred to as a distal wiping, laterally disposed wiper 30, which is shown apart in FIGS. 9 and 10 and in relation to the remainder of the cosmetic applicator 10 in FIGS. 1A and 1B, has a bottom wall 58 communicating laterally across the bottle sleeve 14 distal to the cosmetic applicator 15 and the applicator wand 16, such as at the base of the neck 40. The wiper 30 has a peripheral wall 56 for enabling its secure retention in relation to the bottle sleeve 14. A plurality of radially communicating slits 54 are disposed in the bottom wall 58. The wiper 30 can be formed from a flexible polymer, such as thermoplastic elastomer (TPE), which again can preferably have a hardness in the range of Shore 46 D.

So disposed, the wiper 30 presents a substantially continuous surface when not-deflected to substantially seal the open inner volume of the bottle sleeve 14 while allowing the cosmetic applicator 15 to pass therethrough when the applicator wand 16 is extended. Advantageously, in addition to providing some wiping of the lateral surfaces of the cosmetic applicator 15, the wiper 30 will wipe any accumulation of cosmetic that is disposed at the tip of the applicator 15 thereby preventing tailing and the waste, messiness, and other deleterious results thereof.

Figure 11:
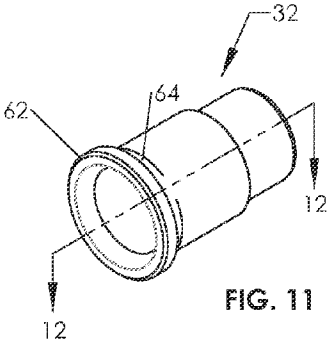
FIG. 11 is a perspective view of a longitudinal wiper according to the current invention.
Figure 12:
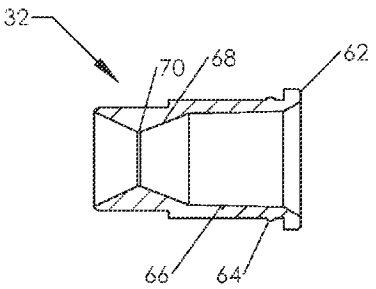
FIG. 12 is a cross-sectional view of the longitudinal wiper taken along the line 12-12 in FIG. 11.

The cosmetic dispenser 10 additionally incorporates what can be referred to as a side wiping wiper 32 that in this case is retained within the neck 40 of the bottle sleeve 14 distal to the distal wiping, laterally disposed wiper 30. With further reference to FIGS. 11 and 12, the wiper 32 has a peripheral ridge 64 for engaging a peripheral channel 60 adjacent to the distal end of the neck 40 of the bottle sleeve 40 and a rim 62 that overlies the distal end of the neck 40 thereby to retain the wiper 32 in place. The wiper 32 has a distal portion with an outer diameter dimensioned to be received snugly in the neck 40 and a proximal portion with an outer diameter reduced to enable the reception of the peripheral wall of the wiper 30 between it and the neck 40.

The wiper 32 has a longitudinally communicating annular inner wall portion 66 adjacent to the distal end thereof and a frusto-conical inner portion 68 that narrows to an annular inner throat 70. The throat 70 is dimensioned for close engagement with the cosmetic applicator 15 and the applicator wand 16. Under this arrangement, after having its distal end wiped by the distal wiping, laterally disposed wiper 30, the cosmetic applicator 15 and then the applicator wand 16 can slide through the side wiping wiper 32. The throat 70 will wipe the cosmetic liquid or paste from the cosmetic applicator 15 and the wand 16 thereby to ensure proper loading of the applicator 15 for optimal makeup application and to ensure efficient product usage and a reduced potential for mess. The wiper 32 can be formed from any suitable material. In one preferred embodiment, low density polyethylene is preferable.

Figure 13:
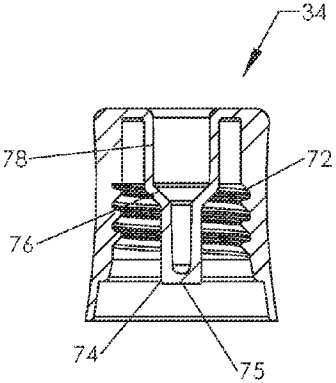
FIG. 13 is a cross-sectional view of a cap under the disclosed invention.

With combined reference to FIGS. 1A, 1B, and 13, one sees that the cap 34 can have a threaded peripheral wall 72 for threadedly engaging the neck 40 of the bottle sleeve 14 and a concentric plug 75 projecting proximally from the distal end of the cap 34. The plug 75 can be dimensioned and shaped to mate with the side wiping wiper 32. As such, the plug 75 can have a longitudinally communicating tip 74 sized to be received closely within the throat 70, a frusto-conical portion 76 corresponding to the frusto-conical portion 68 of the wiper 32, and a longitudinally communicating base portion 78 sized to be received closely within the inner wall portion 66 of the wiper 32. With this, the plug 75 can cooperate with the remainder of the cap 34 in sealing the bottle sleeve 14 while effectively pushing back-wiped cosmetic material back into the open inner volume of the bottle sleeve 14.

It will be appreciated, of course, that the shapes and configurations of the various components of the cosmetic dispenser 10 could vary within the scope of the invention. For example, although the base shell 12 and the bottle sleeve 14 are shown as oval in cross section, round, rectangular, and otherwise shaped structures could readily be constructed based on this disclosure. Similarly, while components such as the applicator wand 16, the through-hole 55 in the seal 28, and the inner surface of the wiper 32 are depicted as having annular cross sections, it would be within the scope of the invention, except as explicitly limited, for those components to pursue non-circular cross sections, whether oval, square, or some other shape.

The disclosed cosmetic dispenser 10 overcomes many of the disadvantages of the prior art while providing useful advantages thereover. For example, extension and retraction of the applicator 15 and the applicator wand 16 by use of the slide button 20 enables effective one-handed operation of the cosmetic dispenser 10. With the distal and side wiping provided by the distal wiping wiper 30 and the side wiping wiper 32, the cosmetic dispenser 10 ensures proper loading of the applicator 15 while reducing the inconvenience and mess that can derive from improper loading, tailing, and the like. Still further, with the reception well defined by the bottle sleeve 14 and the rear seal 28, the cosmetic dispenser 10 can reduce waste by permitting usage of a greater percentage of retained cosmetic material.

With certain details of the present invention for a cosmetic dispenser 10 disclosed, it will be appreciated by one skilled in the art that changes and additions could be made thereto without deviating from the spirit or scope of the invention. This is particularly true when one bears in mind that the presently preferred embodiments merely exemplify the broader invention revealed herein. Accordingly, it will be clear that those with certain major features of the invention in mind could craft embodiments that incorporate those major features while not incorporating all of the features included in the preferred embodiments.

Therefore, the following claims are intended to define the scope of protection to be afforded to the inventors. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, these claims shall be construed to cover not only the corresponding structure and material expressly described in this specification but also all equivalents thereof that might be now known or hereafter discovered.

We claim as deserving the protection of Letters Patent:

1. A cosmetic dispenser comprising:

a bottle with an open inner volume, a closed proximal end, and a distal end with an aperture;

an applicator wand retained for slidable extension and retraction relative to the bottle wherein the applicator wand has a proximal end and a distal end;

a base member fixed to the proximal end of the applicator wand;

a cosmetic applicator retained by the distal end of the applicator wand;

a means for enabling a selective sliding of the applicator wand from a retracted position wherein the cosmetic applicator is retained within the open inner volume of the bottle and an extended position wherein the cosmetic applicator projects through the aperture at the distal end of the bottle;

a lateral dividing structure that divides the open inner volume of the bottle into a distal open inner volume to a distal side of the lateral dividing structure and in fluidic communication with the aperture in the distal end of the bottle and a proximal open inner volume to a proximal side of the lateral dividing structure wherein the distal open inner volume is fluidically sealed in relation to the proximal open inner volume; and an aperture in the dividing structure wherein the applicator wand is slidably received through the aperture wherein the lateral dividing structure comprises an adapter insert and a rear seal wherein the adapter insert has a base and a peripheral wall, wherein the aperture is in the base concentric with the bottle, and wherein the peripheral wall has a size and shape corresponding to a size and shape of an inner wall surface of the bottle and wherein the rear seal has a through-hole that slidably receives the applicator wand.

2. The cosmetic dispenser of claim 1 wherein the means for enabling a selective sliding of the applicator wand comprises a slide channel that communicates longitudinally along the bottle in combination with a slide member and a means for engaging the slide member with the applicator wand through the slide channel.

3. The cosmetic dispenser of claim 2 wherein the means for engaging the slide member with the applicator wand comprises at least one leg with a first end fixed to the slide member and a second end engaged with the base member fixed to the proximal end of the applicator wand.

4. The cosmetic dispenser of claim 1 wherein the bottle is formed by a base shell with a closed proximal end and an open distal end and a bottle sleeve with an open proximal end for engaging the open distal end of the base shell.

5. The cosmetic dispenser of claim 4 wherein the adapter insert further comprises a peripheral rim that overlies the distal end of the base shell.

6. The cosmetic dispenser of claim 1 wherein the rear seal comprises a base and a peripheral wall.

7. The cosmetic dispenser of claim 6 wherein the rear seal is matingly engaged with the adapter insert and wherein the bases of the rear seal and the adapter insert are disposed proximal to the peripheral walls of the rear seal and the adapter insert whereby the peripheral walls and the base portions cooperate to define a reception well.

8. The cosmetic dispenser of claim 1 further comprising a laterally disposed distal wiping wiper wherein the distal wiping wiper comprises a bottom wall that communicates laterally across the open inner volume of the bottle distal to the cosmetic applicator and the applicator wand when the applicator wand is in a retracted position and wherein there is at least one slit in the bottom wall for permitting a passage of the cosmetic applicator through the distal wiping wiper and for enabling a wiping of a distal end of the cosmetic applicator.

9. The cosmetic dispenser of claim 8 wherein the bottom wall of the distal wiping wiper has a plurality of radial slits.

10. The cosmetic dispenser of claim 8 further comprising a side wiping wiper within the bottle wherein the side wiping wiper has a longitudinal inner wall portion adjacent to a distal end thereof and a frusto-conical inner portion that narrows to an inner throat.

11. The cosmetic dispenser of claim 10 wherein the side wiping wiper is disposed distal to the distal wiping wiper within the bottle.

12. The cosmetic dispenser of claim 10 further comprising a cap for sealing the distal open inner volume of the bottle wherein the cap has a concentric plug that projects proximally to mate with the side wiping wiper.

13. The cosmetic dispenser of claim 12 wherein the plug of the cap has a tip for being received within the throat of the side wiping wiper and a frusto-conical portion corresponding to the frusto-conical inner portion of the side wiping wiper.

14. A cosmetic dispenser comprising:

a bottle with an open inner volume, a closed proximal end, and a distal end with an aperture;

an applicator wand retained for slidable extension and retraction relative to the bottle wherein the applicator wand has a proximal end and a distal end;

a base member fixed to the proximal end of the applicator wand;

a cosmetic applicator retained by the distal end of the applicator wand;

a means for enabling a selective sliding of the applicator wand from a retracted position wherein the cosmetic applicator is retained within the open inner volume of the bottle and an extended position wherein the cosmetic applicator projects through the aperture of the distal end of the bottle wherein the means for enabling a selective sliding of the applicator wand comprises a slide channel that communicates longitudinally along the bottle in combination with a slide member and a means for engaging the slide member with the applicator wand through the slide channel;

a lateral dividing structure that divides the open inner volume of the bottle into a distal open inner volume to a distal side of the lateral dividing structure and in fluidic communication with the aperture in the distal end of the bottle and a proximal open inner volume to a proximal side of the lateral dividing structure wherein the distal open inner volume is fluidically sealed in relation to the proximal open inner volume;

an aperture in the dividing structure wherein the applicator wand is slidably received through the aperture;

a laterally disposed distal wiping wiper wherein the distal wiping wiper comprises a bottom wall that communicates laterally across the open inner volume of the bottle distal to the cosmetic applicator and the applicator wand when the applicator wand is in a retracted position and wherein there is at least one slit in the bottom wall for permitting a passage of the cosmetic applicator through the distal wiping wiper and for enabling a wiping of a distal end of the cosmetic applicator; and a side wiping wiper with an annular inner throat wherein the side wiping wiper is disposed distal to the distal wiping wiper within the bottle.

15. The cosmetic applicator of claim 14 wherein the lateral dividing structure comprises an adapter insert and a rear seal wherein the adapter insert has a base and a peripheral wall wherein the aperture is in the base concentric with the bottle and wherein the peripheral wall has a size and shape corresponding to a size and shape of an inner wall surface of the bottle and wherein the rear seal has a base with a through-hole that slidably receives the applicator wand.

16. The cosmetic dispenser of claim 15 wherein the rear seal further comprises a peripheral wall, wherein the rear seal is matingly engaged with the adapter insert, and wherein the bases of the seal and the adapter insert are disposed proximal to the peripheral walls of the seal and the adapter insert whereby the peripheral walls and the base portions cooperate to define a reception well.

17. The cosmetic dispenser of claim 14 wherein the side wiping wiper has a longitudinal annular inner wall portion adjacent to a distal end thereof and a frusto-conical inner portion that narrows to the annular inner throat.

18. The cosmetic dispenser of claim 17 further comprising a cap for sealing the distal open inner volume of the bottle wherein the cap has a concentric plug that projects proximally to mate with the side wiping wiper.

19. The cosmetic dispenser of claim 18 wherein the plug of the cap has a tip for being received within the throat of the side wiping wiper and a frusto-conical portion corresponding to the frusto-conical inner portion of the side wiping wiper.

* * * * *